United States Patent [19]

Schroeder et al.

[11] 4,278,961

[45] Jul. 14, 1981

[54] INSULATING COATING FOR SURGE ARRESTER VALVE ELEMENT

[75] Inventors: James E. Schroeder, Greenfield; John F. Rasmussen, Franklin, both of Wis.

[73] Assignee: McGraw-Edison Company, Rolling Meadows, Ill.

[21] Appl. No.: 898,621

[22] Filed: Apr. 21, 1978

Related U.S. Application Data

[63] Continuation of Ser. No. 786,223, Apr. 11, 1977, abandoned.

[51] Int. Cl.[3] ..... H01C 7/10

[52] U.S. Cl. ..... 338/21; 361/127

[58] Field of Search ..... 338/21, 20; 361/37–39, 361/120, 127; 29/610

[56] References Cited

U.S. PATENT DOCUMENTS

| | | | |
|---|---|---|---|
| 3,096,496 | 7/1963 | Burrage et al. | 338/21 |
| 3,207,624 | 9/1965 | Burrage et al. | 338/21 X |
| 3,269,974 | 8/1966 | Childs | 260/37 |
| 3,725,745 | 4/1973 | Zisa | 338/21 X |
| 3,757,152 | 9/1973 | Charpontier | 338/21 X |
| 3,974,105 | 8/1976 | Sato et al. | 338/25 X |
| 4,074,221 | 2/1978 | Milligan | 338/21 |

*Primary Examiner*—C. L. Albritton

*Attorney, Agent, or Firm*—Roy A. Ekstrand; Jon Carl Gealow; Ronald J. LaPorte

[57] ABSTRACT

An electrical insulating coating of thermosetting polymeric material for a surge arrester valve element of silicon carbide particles bound together within a ceramic matrix, in which the coating is applied in powder form. Curing of the coating is effected either by a heating cycle following the application of the powder insulating coating, or by preheating of the valve element before application of the powder coating. Alternately, the insulating coating can be applied as a plasma spray, making post-curing unnecessary.

3 Claims, 1 Drawing Figure

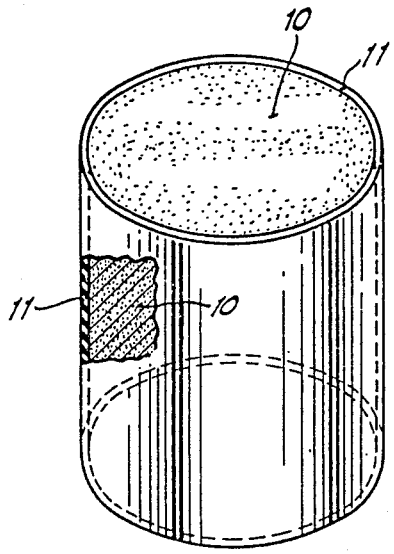
10
11
11
10

INSULATING COATING FOR SURGE ARRESTER VALVE ELEMENT

This is a continuation of application Ser. No. 786,223 filed Apr. 11, 1977 and now abandoned.

BACKGROUND OF THE INVENTION

The invention relates to nonlinear resistive valve elements of surge arresters, and more particularly to an electrical insulating coating therefor.

Surge arresters are used in electrical power systems for limiting surge voltages on the power lines and the equipment connected thereto by discharging or bypassing surge current to ground. These surge arresters include a series gap which normally insulates the surge arrester from the power system, but which sparks over when the voltage across the series gap becomes excessive. Valve elements, connected between the series gap and ground, are used to limit the power follow current subsequent to a drop in the impressed voltage so that the series gap can then interrupt the follow current and again insulate the surge arrester from the power system. To perform this function, the valve element must have the capacity to discharge high currents at excessive voltages while increasing its resistance to discharges at normal voltages.

In a cylindrical shaped valve element such as that disclosed in U.S. Pat. No. 3,813,296 issued May 28, 1974, to Darrell D. McStrack and James E. Schroeder, the valve element is composed of silicon carbide particles bound together within a ceramic matrix. During voltage surges the silicon carbide particles are subjected to high voltage stresses which can cause ionization of the air in contact with the particles. If the insulation strength of the air between the particles is exceeded, an arc discharge will occur. Accumulation of these discharge arcs can cause a complete valve element flashover across the outer cylindrical surface of the valve element. Once the valve element has flashed over, the valve element is ineffective in limiting the power follow current. Consequently the series gaps cannot interrupt the high power follow current, and failure of the surge arrester results.

To prevent such flashover failure of the surge arrester, it is necessary to apply an electrically insulating coating over the outside surface of the valve element, which is free from pin holes and completely bonded to the valve element body so that the area between the body and the coating is free of voids through which arcs can travel. In order to meet the requirements of the American National Standard, A.N.S.I C62.1-1975, entitled "Surge Arresters for Alternating Current Power Circuits", this insulating coating must not only have a high electrical breakdown strength, but also must have good mechanical strength and high resistance to cracking to withstand the sudden pressure exerted on it while a surge current is flowing through the valve element caused by expanding gases within the valve element. Also it must retain these mechanical and electric properties over a wide temperature range, from the lowest ambient temperature expected to be encountered at the locations where surge arresters are used, to a peak high temperature of the valve element and coating caused by repeated operations of the surge arrester within a relatively short period of time.

In the past, ceramic electrically insulating coatings, such as that described in the above-referenced U.S. Pat. No. 3,813,296, have been used to insulate the cylindrical sides of valve elements of silicon carbide particles bound together within a ceramic matrix. Generally, the materials comprising the ceramic coating are mixed together in suitable milling apparatus, such as a ball mill, to improve the smoothness and decrease the porosity of the final coating, then degassed to remove any air entrapped during mixing and thus minimize potential voids in the ceramic coating. Next, the ceramic coating mixture is applied to the valve element before the valve element has been fired to cure its ceramic matrix. The coated valve element is then fired at an elevated temperature to mature both the ceramic matrix of the valve element and the ceramic forming ingredients of the coating mixture.

While the single firing procedure of the coated valve element reduces the time required to manufacture these valve elements, it does not allow the valve valve elements to be inspected after firing for cracks which can develop during firing underneath the insulating coating. Also, an insulating coating which can be more easily prepared and applied to the valve element than known ceramic coatings would be highly desirable.

SUMMARY OF THE INVENTION

Therefore, a primary object of the invention is to provide a smooth, tough, highly adherent, electrical insulating coating for a surge arrester valve elements which is easily prepared and applied to the valve element after the valve element has been fired and inspected for cracks.

Another object of the invention is to provide a thermosetting polymeric insulating coating for the valve elements of surge valve arresters which meet or exceed test requirements for valve arresters specified by the above-referenced American National Standard, A.N.S.I. C62.1-1975.

The coating disclosed herein comprises an anhydride cured bisphenol-A epoxy resin powder coating material which is applied to the valve element after firing by a dipping or spraying process, then heat cured to produce a uniform, pinhole-free, insulating coating having a minimal thickness of approximately 5 mils. Plasma spray application of this coating material is also possible, making post-curing unnecessary.

BRIEF DESCRIPTION OF THE DRAWINGS

A more complete understanding of the invention and its advantages can be obtained by reference to the following detailed description, together with the accompanying drawing wherein:

The sole FIGURE is a perspective view of a valve element to which the improvement described herein has been applied.

DESCRIPTION OF PREFERRED EMBODIMENTS

The valve element 10 shown in FIG. 1 includes a solid, cylindrical body of silicon carbide particles tightly held together in intimate contact within a ceramic matrix, having its cylindrical side covered by a tightly adhering, pinhole-free, polymeric electrically insulating coating 11 having a minimum thickness of at least 5 mils.

An anhydride cured Bisphenol-A epoxy resin powder coating material is used to form the insulating coating 11. Any polybasic organic anhydride for use with Bis-A epoxies can be used. For example, any of the following commonly used anhydrides are suitable: phthalic anhydride, hexahydrophthalic anhydride, or methyl 4-endomethylene-tetrahydrophthalic anhydride.

The insulating coating 11 can be applied to the valve element 10 by any one of several methods. The valve element 10 can be preheated above the melting temperature of the powder coating material, and then either the powder coating material is sprayed onto the valve element 10, or the valve element 10 is dipped into a suspension of the powder coating material, as in a fluidized bed. Other methods include the spraying of electrostatically charged powder coating material, passage over an electrostatic fluidized bed of powder coating material, or passage through a cloud of charged powder coating material, each followed by a heat curing cycle. Also, plasma spray application of the insulating coating 11 can be used to make the need of any post-curing operation unnecessary.

In a preferred method of applying the insulating coating 11, pressed, fired, ceramic-bonded valve elements 10 were heated to 150° C., dipped in a fluidized bed suspension of an anhydride cured bisphenol-A epoxy resin powder coating material for five seconds, then removed from the suspension and allowed to cool. The coated valve elements 10 were then assembled into surge arresters, and tested in accordance with A.N.S.I. C62.1-1975. None of the insulating coatings 11 failed during these tests and no negative differences were detected between surge arresters using valve elements 10 having an insulating coating 11 of polymeric insulating material and surge arresters with valve elements coated with the usual ceramic insulating coating. During the duty cycle test specified in Section 7.6.1 of the A.N.S.I. Standard C62.1-1975, consisting of 24 unit operations with a maximum time interval between unit operations of one minute, in which an 8×20 microsecond current wave with a crest value of 10,000 amperes is applied to the surge arrester being tested, the polymeric insulating coating 11 retained its mechanical and electrical properties at elevated peak temperatures in the range of 300°–400° C. Surge arresters using valve elements 10 coated with the insulating coating 11 described herein exceeded the high current short duration test specified in Section 7.5.1 of the A.N.S.I. Standard C62.1-1975, by passing two 6×13 microsecond surges having a crest current of 100,000 amperes. Also the insulating coating 11 retained its strength and toughness at ambient temperatures down to −35° C.

In summary, the advantages of using surge arrester valve elements 10 having the thermosetting powder insulating coating 11 described herein are:

(1) The valve elements 10 can be formed or cut to the proper length before firing and fired uncoated. The valve elements 10 can then be examined for cracks before applying the insulating coating 11.

(2) Grinding, deairing and handling of liquid ceramic insulating coatings or glazes is eliminated.

(3) The coating of the valve elements 10 with a dry insulating coating 11 can be more easily automated than the application of a wet ceramic glaze.

(4) The insulating coatings 11 provide 100,000-ampere surge protection, well in excess of that provided by known ceramic glazes.

Many modifications and variations of this invention will be readily apparent to those skilled in the art, as, for example, the use of an active material for the valve element 10 other than silicon carbide which exhibits negative resistance characteristics, or the use of a non-ceramic binding material. Consequently, it is intended in the appended claims to cover all such modifications and variations which fall within the scope of the invention.

What is claimed is:

1. A valve element of a surge arrestor for an alternating current power circuit, said valve element including non-linear resistive particles tightly held together in intimate contact within a ceramic matrix, said valve element having opposite end surfaces defining an axis therebetween, an outer axially-extending surface intermediate the opposite ones of said end surfaces, said valve element being characterized by an electrically insulating coating intimately adhered to the outer axially extending surface of said valve element, said coating comprising a thermoset, anhydride cured, Bisphenol-A epoxy resin material.

2. A surge arrester valve element, as described in claim 1, wherein said valve element comprises silicon carbide particles bound together within a ceramic matrix.

3. A valve element of a surge arrester for an alternating-current power circuit, capable of discharging twenty-four 8×20 microsecond current surges, each having minimum crest value of 10,000 amperes, with a maximum time interval between successive surges of one minute, said valve element including nonlinear resistive particles bound together within a ceramic matrix, said valve element having opposite ends surfaces defining an axis therebetween, and an outer axially extending surface intermediate the opposite one of said end surfaces, and said valve element being characterized by an electrically insulating coating intimately adhered to the outer axially extending surface of said valve element, said coating comprising a thermoset, anhydride cured, Bisphenol-A epoxy resin material.

* * * * *